United States Patent [19]

Diesner et al.

[11] 4,059,133

[45] Nov. 22, 1977

[54] WEFT INSERT APPARATUS FOR RIBBON LOOMS

[76] Inventors: Ferdinand Diesner, Spittelweg 1, D-8998 Murg-Hanner, Germany; Robert Bucher, Frickbergstrasse, CH-5262 Frick, Switzerland

[21] Appl. No.: 673,819

[22] Filed: Apr. 5, 1976

[30] Foreign Application Priority Data

Apr. 4, 1975 Switzerland ..... 4275/75

[51] Int. Cl.[2] ..... D03D 47/02

[52] U.S. Cl. ..... 139/440

[58] Field of Search ..... 139/431, 432, 440, 441, 139/442

[56] References Cited

U.S. PATENT DOCUMENTS

| | | | |
|---|---|---|---|
| 159,653 | 2/1875 | Dornan | 139/440 |
| 633,020 | 9/1899 | MacDonald | 139/440 |
| 2,625,959 | 1/1953 | Turner | 139/431 |
| 3,682,205 | 8/1972 | Scott | 139/442 |

FOREIGN PATENT DOCUMENTS

| | | | |
|---|---|---|---|
| 4,319 of | 1887 | United Kingdom | 139/442 |

*Primary Examiner*—Henry S. Jaudon
*Attorney, Agent, or Firm*—Werner W. Kleeman

[57] ABSTRACT

The present invention relates to a weft insert apparatus for a shuttleless loom, especially a ribbon loom, comprising two cooperating weft insert elements moved towards one another, the weft insert elements moving about pivot axes in such a manner that their free ends describe curves, and comprising at least one tying needle.

5 Claims, 7 Drawing Figures

WEFT INSERT APPARATUS FOR RIBBON LOOMS

BACKGROUND OF THE INVENTION

It is known in shuttleless looms to insert the weft threads into the shed by means of linear to-and-fro moved rod-like elements introduced into the shed from both sides, in such a manner that one of these elements, by means of a gripper arranged at a free end, introduces the weft thread to a point somewhat past the fabric center into the shed and that the second element, likewise by means of a gripper, seizes the weft thread at that location, so that upon retraction of both elements the weft thread is drawn and inserted completely through the shed. Such type apparatus is described in British Pat. No. 546,493. Such weft insert apparatuses are associated with the drawback that the linearly moved weft insert elements are moved in guides, so that considerable wear occurs thereat as well as also at the weft insert elements. Additionally, producing the linear movements requires complicated mechanisms having large moving masses, so that there cannot be realized any high weaving speeds.

On the other hand, it is part of the state-of-the-art to use weft insert elements moved at one side both linearly as well as also in an oscillating fashion, which insert into the shed the weft thread over the entire fabric width. On the one hand, owing to the longer path which they must move through and, on the other hand, their pronounced vibration brought about by the large length, also these weft insert elements are not suitable for attaining high weaving speeds.

Finally there is also known from German patent publication No. 1,804,973 a weft insert apparatus in which there are arranged at each side of the fabric two oscillating weft insert elements and guide two weft threads, a respective one from each side of the fabric, up to the center, where they are interlaced by means of a tying thread with the aid of a tying needle. This weft insert apparatus is disadvantageous because there is required apart from the movement mechanism for both weft insert elements also an additional movement mechanism for the central needle which must function in synchronism with both weft insert elements, quite apart from the fact that such fabrics always exhibit at the center a cord-like crochet bead.

All of these known weft insert apparatuses moreover only enable the insertion of double picks.

SUMMARY OF THE INVENTION

The object of the invention is the provision of a weft insert apparatus of the above defined type with which each of the weft insert elements in each case only must oscillatingly pass through a part of the shed, in other words can be moved rapidly and vibration-free by means of a simple mechanism, and wherein the weft insert elements are constructed such that there occurs a positive thread transfer.

This weft insert apparatus of the previously mentioned type is characterized according to the invention by the features that both weft insert elements moved towards one another for the insertion of a single- or multiple weft thread are constructed to rock, and one thereof exhibits at its free end a thread eyelet, a clamp or a notch for the infeed of the weft thread, whereas the free end of the other weft insert element is provided with a hook or a clamp for seizing the thread.

It has been found that with such a weft insert apparatus there can be realized particularly high operating speeds free of vibration or low in vibration.

Particularly advantageous results can be obtained by constructing the hook with a web directed approximately radially to the rocking axis and having an enlarged portion. In this way there is realized on the one hand a positive transfer of the weft thread and, on the other hand, the weft insert element can be adjusted such that the weft thread can slide from the hook without pulling out fibers.

Particularly good results can be obtained if the shoulder located between the web and the enlarged portion, together with the web forms an angle of 90° to 100°.

The manipulation of the weft thread at the hook of the weft insert element is facilitated if the shoulder at the side confronting the web transforms into a rounded portion of small radius and at the side facing away from the web into a rounded portion of large radius.

It is further of advantage if the enlarged portion at the side facing away from the web runs-out into a tip, thereby facilitating the engagement of the hook into the loop of the weft thread.

A further especially advantageous construction of the weft insert element carrying the hook is obtained if the enlarged portion is constructed rotationally symmetrical with respect to the axis of the web. Then both of the legs of the loop of the weft thread can be held at a certain spacing from one another, facilitating the engagement of the tying needle.

BRIEF DESCRIPTION OF THE DRAWINGS

Exemplary embodiments of the inventive weft insert apparatus will be described more fully hereinafter in conjunction with the drawings, wherein there is shown.

DETAILED DESCRIPTION OF THE PREFERRED EMBODIMENTS

Figure 1:
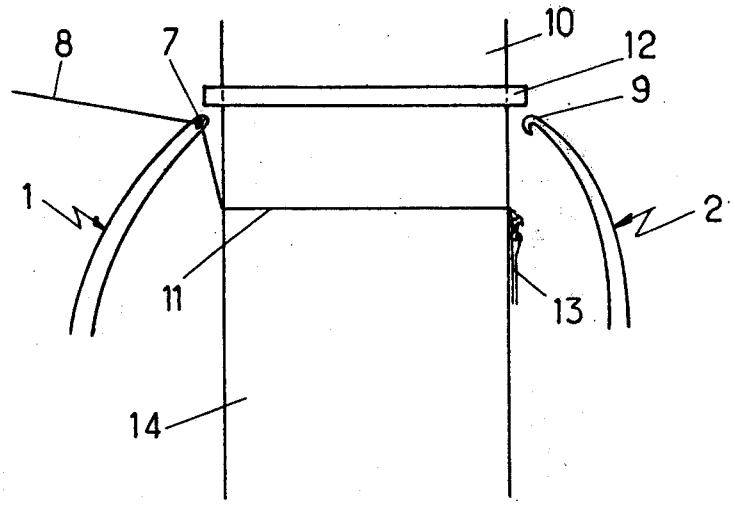
FIGS. 1 to 4 a first weft insert apparatus in schematic plan view, wherein the weft insert elements are illustrated in four different operating positions and FIG. 2 also portrays their drive mechanism.
Figure 3:
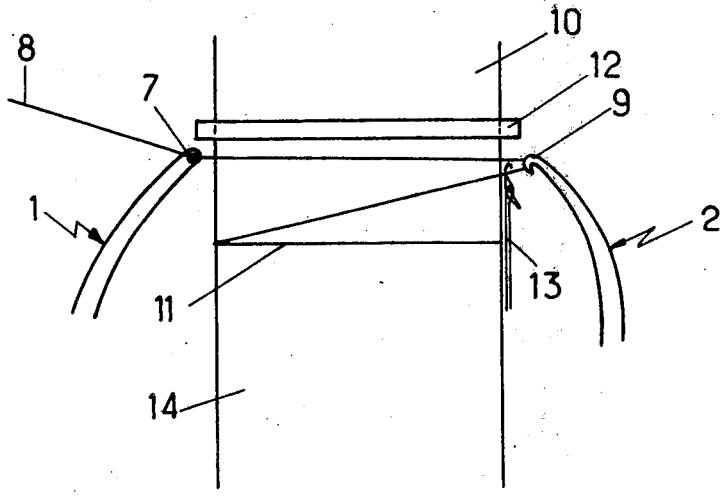
Figure 4:
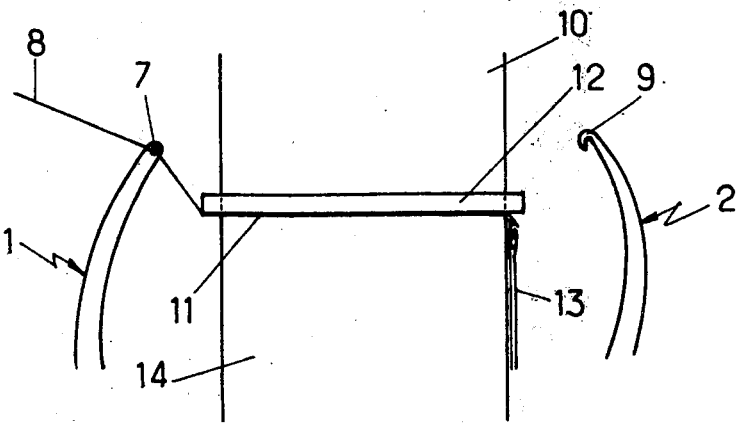
Figure 2:
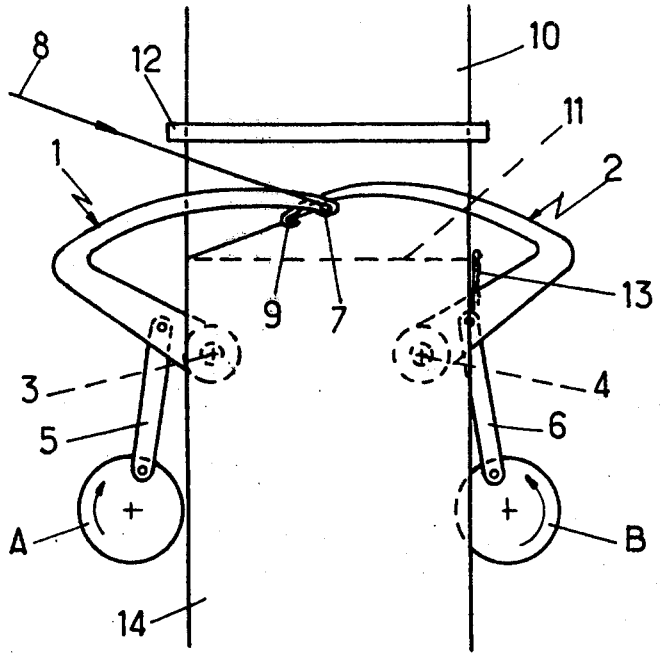

The weft insert apparatus illustrated in FIGS. 1 to 4 contains two weft insert elements 1 and 2, which rock about the pivot shafts 3 and 4 and are placed into a rocking or oscillating motion by the crank disks A and B via the connecting rods 5 and 6. The free end of the weft insert element 1 possesses a thread eyelet 7 through which there is introduced the weft thread 8, whereas the free end of the weft insert element 2 is provided with a hook 9 functioning as a gripper. By means of warp threads there is formed a shed 10 which terminates at the fabric beating edge 11. The reed 12 serves to beat-up the individual weft threads 8. A tying needle 13 serves to tie the weft thread at one edge of the ribbon 14 to be woven.

The weft insert apparatus functions in the following manner:

During a first operating step according to FIG. 1, when the weft insert elements 1, 2 are rocked towards the outside and the reed 12 has the greatest spacing from the fabric beating edge 11, only the weft insert element 1 is connected with the weft thread 8 guided through the eyelet 7, whereas the weft insert element 2 and its hook 9 respectively, are empty. In the second operating step according to FIG. 2 the weft insert element 1, upon rocking into the shed, draws the weft thread 8 up to the illustrated position. In this position the free end of the weft insert element 2 has crossed the free end of the weft insert element 1, which is possible owing to the curved construction of both of these elements, and the hook 9 engages the weft thread 8. During the third operating step according to FIG. 3, in which both of the weft insert elements 1, 2 are again rocked towards the outside, the weft thread 8 is moved out of the shed towards the right by the hook 9, thereby slides through the eyelet 7 of the likewise outwardly rocking web insert element 1 and is engaged by the tying needle 13. During the fourth operating step according to FIG. 4 both of the weft insert elements 1, 2 have again reached their outermost position. The weft thread 8 is hooked by the tying needle 13, the reed 12 has carried out the beat-up operation and the shed has changed. Thereupon the operation can begin anew.

In order to facilitate and render positive the thread transfer the drive elements, for instance both of the crank disks A, B, can be somewhat shifted in time relative to one another, so that the one weft insert element in each case rocks somewhat sooner than the other.

Figure 5:
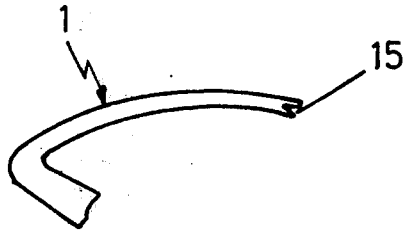
FIG. 5 shows the free end of the infeed-weft insert elememt in a modified form.

The embodiment illustrated in FIG. 5 provides, instead of a thread eyelet 7 at the weft insert element 1, a notch 15 which infeeds the weft thread 8 to the hook 9, wherein however the remainder of the course of operation proceeds exactly as explained above. The use of a notch 15 instead of an eyelet 7 enables alternatingly inserting into the shed different weft threads, whereby it is sufficient to bring in each instance into a preparatory position in front of the notch 15 the desired weft thread during rocking-in of the weft insert element 1.

Figure 6:
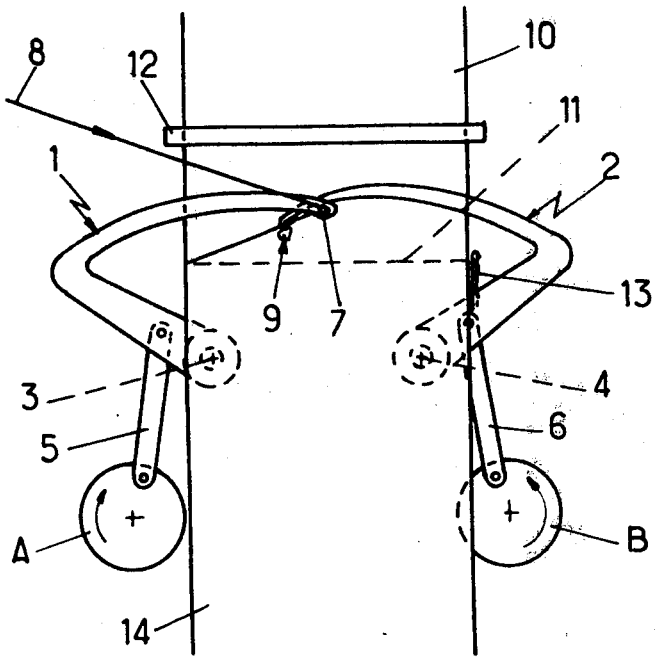
FIG. 6 shows a further construction of the weft insert apparatus in schematic plan view.
Figure 7:
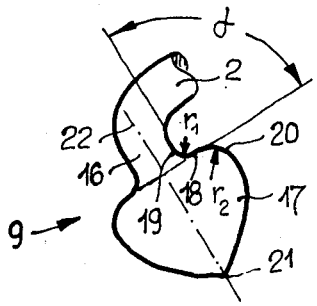
FIG. 7 shows the hook of the weft insert element of FIG. 6 on an enlarged scale.

A further particularly advantageous construction of hook is shown in FIGS. 6 and 7. This hook 9 consists of a web 16 directed approximately radially with respect to the rocking shaft 4, which web is provided with a subsequent enlarged portion 17 pointing in the direction of the loop of the thread 8. The enlarged portion has a shoulder 18 extending approximately transverse to the web. Such forms together with the web an angle $\alpha$, preferably amounting to 90° to 100°.

The shoulder 18 merges at the side confronting the web 16 into a rounded portion 19 of small radius $r_1$. At the side facing away from the web 16 there is provided a rounded portion 20 of larger radius $r_2$. The enlarged portion 17 runs-out at the side facing away from the web 16 into a tip 21.

Although the enlarged portion 17 need only be provided at the side pointing in the direction of the loop of the weft thread 8 and moreover can be of flat construction, so that it extends in the plane of movement of the weft insert element 2, it has been found to be advantageous to construct the enlarged portion to be mirror-image symmetric with respect to the axis 22 of the web. It is of even greater advantage if the enlarged portion is constructed to be rotationally symmetrical with respect to the axis 22.

This exceptionally simple weft insert apparatus having short rocking movements and easy adjustmemt possibility, enables weaving with maximum weft speeds and small maintenance and practically without any susceptibility to disturbances. Also it is possible therewith to insert the weft thread not only as a double pick, but with appropriate modification of the illustrated embodiment also as a single pick. While there are shown and described present preferred embodiments of the invention, it is to be distinctly understood that the invention is not limited thereto, but may be otherwise variously embodied and practiced within the score of the following claims.

Accordingly we claim:

1. A weft insert apparatus for a shuttleless loom, especially a ribbon loom, comprising two cooperating weft insert elements each having a free end, means mounting said weft insert elements for movement towards and away from one another such that their free ends describe curves, drive means cooperating with said weft insert elements for pivotably driving said weft insert elements towards and away from one another, one of said weft insert elements being provided at its free end with means for the infeed of the weft thread, the other weft insert element being provided at its free end with means for seizing the weft thread, said seizing means comprises a hook, the means mounting the weft insert element possessing a hook includes a pivot shaft, the hook of said weft insert element possessing a web directed approximately radially with respect to the free end of the weft insert element mounted at said pivot shaft, an enlarged portion formed at one end of said web and pointing in the direction of a loop of the weft thread, said enlarged portion containing a shoulder which extends approximately transversely with respect to the web.

2. The weft insert apparatus as defined in claim 1, wherein the shoulder of the hook together with the web encloses an angle in the order of 90° to 100°.

3. The weft insert apparatus as defined in claim 1, wherein the shoulder merges at the side confronting the web with a rounded portion of smaller radius and the side facing away from the web merges with a rounded portion of larger radius.

4. The weft insert apparatus as defined in claim 1, wherein the enlarged portion at the side facing away from the web runs out into a tip.

5. The weft insert apparatus as defined in claim 1, wherein the web has a predetermined axis, and the enlarged portion is constructed substantially rotationally symmetrical relative to said predetermined axis of the web.

* * * * *